United States Patent [19]

McLeod

[11] Patent Number: 5,012,865

[45] Date of Patent: May 7, 1991

[54] ANNULAR AND CONCENTRIC FLOW WELLHEAD ISOLATION TOOL

[76] Inventor: Roderick D. McLeod, 5104 - 125 Street, Edmonton, Alberta, Canada, T6H 3V5

[21] Appl. No.: 413,187

[22] Filed: Sep. 27, 1989

[51] Int. Cl.[5] ..... E21B 33/03

[52] U.S. Cl. ..... 166/90; 166/95

[58] Field of Search ..... 166/379, 95, 97, 72, 166/73, 90, 75.1

[56] References Cited

U.S. PATENT DOCUMENTS 3,830,304 8/1974 Cummins ..... 166/85 X
4,169,504 10/1979 Scott ..... 166/90
4,657,075 4/1987 McLeod ..... 166/72
4,691,770 9/1987 McLeod ..... 166/73
4,867,243 9/1989 Garner et al. ..... 166/379

*Primary Examiner*—William P. Neuder
*Attorney, Agent, or Firm*—Anthony R. Lambert

[57] ABSTRACT

Apparatus for isolating the wellhead equipment from the high pressure fluids pumped down to the producing formation during the procedures of fracturing and acidizing oil and gas wells utilizes a central mandrel concentric inside an outer mandrel and an expandable sealing nipple to seal the outer mandrel against the casing. The sealing nipple is provided with passageways to allow fluids to be pumped down the tubing and/or the annulus between the tubing and the casing in an oil or gas well.

5 Claims, 13 Drawing Sheets

ANNULAR AND CONCENTRIC FLOW WELLHEAD ISOLATION TOOL

FIELD OF THE INVENTION

This invention relates to an apparatus for use in oil and gas well servicing, and specifically to an apparatus for the isolation of wellhead components from the high pressures encountered when performing the procedures of fracturing and acidizing.

BACKGROUND OF THE INVENTION

Many of the procedures of oilfield well servicing require that fluids and gases mixed with various chemicals and proppants be pumped down the oil or gas well (henceforth called the well) tubing or casing under high Pressures during the operations called acidizing and fracturing. These operations serve to ready the well for Production or enhance the present production of the well.

The components which make up the wellhead such as the valves, tubing hanger, casing hanger, casing head and also the blow out preventer equipment generally supplied by the well servicing company, are usually sized for the characteristics of the well and are not capable of withstanding the fluid pressures at which these operations of fracturing and acidizing are carried out. These wellhead components are available to withstand high pressures, but it is not economical to equip every well with them.

There are many tools which are in use in the field which allow these high pressure fluids and gases to bypass the wellhead components and these tools are generally referred to as wellhead isolation tools or in oilfield terms, tree savers, casing savers and top mounted packers. Some of the most popular in use today would include the authors tools; Mcleod, a Wellhead Isolation Tool, Canadian Patent No. 1217128, U.S. Pat. No. 4657075 this tool being used to isolate the wellhead array from pressure in the casing; McLeod, a Well Casing Packer, Canadian Patent No. 1232536, U.S. Pat. No. 4691770, this tool being used to isolate wellhead equipment from pressure in the casing or tubing, depending on which it is set into; also Bullen, A Well Tree Saver, Canadian Patent No. 194905, this tool being used to isolate the wellhead array from pressure in the tubing; Cummins (Assigned to Halliburton Co.) a Wellhead Isolation Tool and Method of Use Thereof, U.S. Pat. No. 3830304, this tool being used to isolate the wellhead array from pressure in the tubing.

There are other tools operating on the same principle; to insert a mandrel with a sealing nipple on the lower end through the wellhead array and into the tubing or casing below the wellhead, thus isolating the wellhead equipment from the pressure and fluid being pumped into the tubing or casing. The use of these tools in the field is quite common but their ability to seal off only the tubing or the casing (when the tubing has been removed) from the wellhead equipment limits the effectiveness of monitoring the fracturing and acidizing processes and poses problems when stoppages in these processes occur or if the well must be "killed" for some reason. ("Killing" a well is a process whereby weighted fluid is pumped down the well to counterbalance the pressure of the producing formation and stop production. The weighted fluid is usually pumped down the tubing).

It is also desirable from cost and safety standpoints to be able to leave the tubing or as it is sometimes called, the "kill string", in the well during the well servicing.

SUMMARY OF THE INVENTION

The invention comprises an isolating apparatus for inserting high pressure fluid through the low pressure wellhead and associated equipment, and into the well both through the central mandrel of the apparatus which is connected to the tubing in the well and through the annulus in the apparatus which is connected in an annular sealing way in the casing in the well.

In one aspect, the invention comprises an improvement to a wellhead isolation tool having a body for external mounting on a wellhead, the wellhead having well tubing and casing, an outer mandrel supported in the body and having a lower end, and an inner mandrel supported within the outer mandrel and connectable to the well tubing, the improvement comprising:

annular sealing means attached to the lower end of the outer mandrel for sealing against the casing;

first fluid passage means attached to the body for providing fluid into the tubing;

at least one second fluid passage means attached to the body for providing fluid into the annulus between the inner and outer mandrel;

an expander for expanding the sealing means into a sealing relationship with the casing; and the expander having axial passages extending through the expander to provide a connection between the annulus formed by the casing and tubing and the annulus formed by the inner and outer mandrels.

In another aspect, the invention includes the expander being movable in relation to the inner mandrel from a position in which it is away from the sealing nipple to a position in which the sealing nipple is expanded.

In another aspect, the invention includes angled flow passages and wear prevention means disposed on the inner mandrel.

A further summary of the invention may be found in the claims.

BRIEF DESCRIPTION OF THE DRAWINGS

There will now be described preferred embodiments of the invention by way of example with reference to the drawings in which:

FIG. 11 shows a side view cross-section of an apparatus according to the invention in place on the wellhead and ready for fluids to be pumped through;

DETAILED DESCRIPTION OF THE PREFERRED EMBODIMENT

Figure 1:
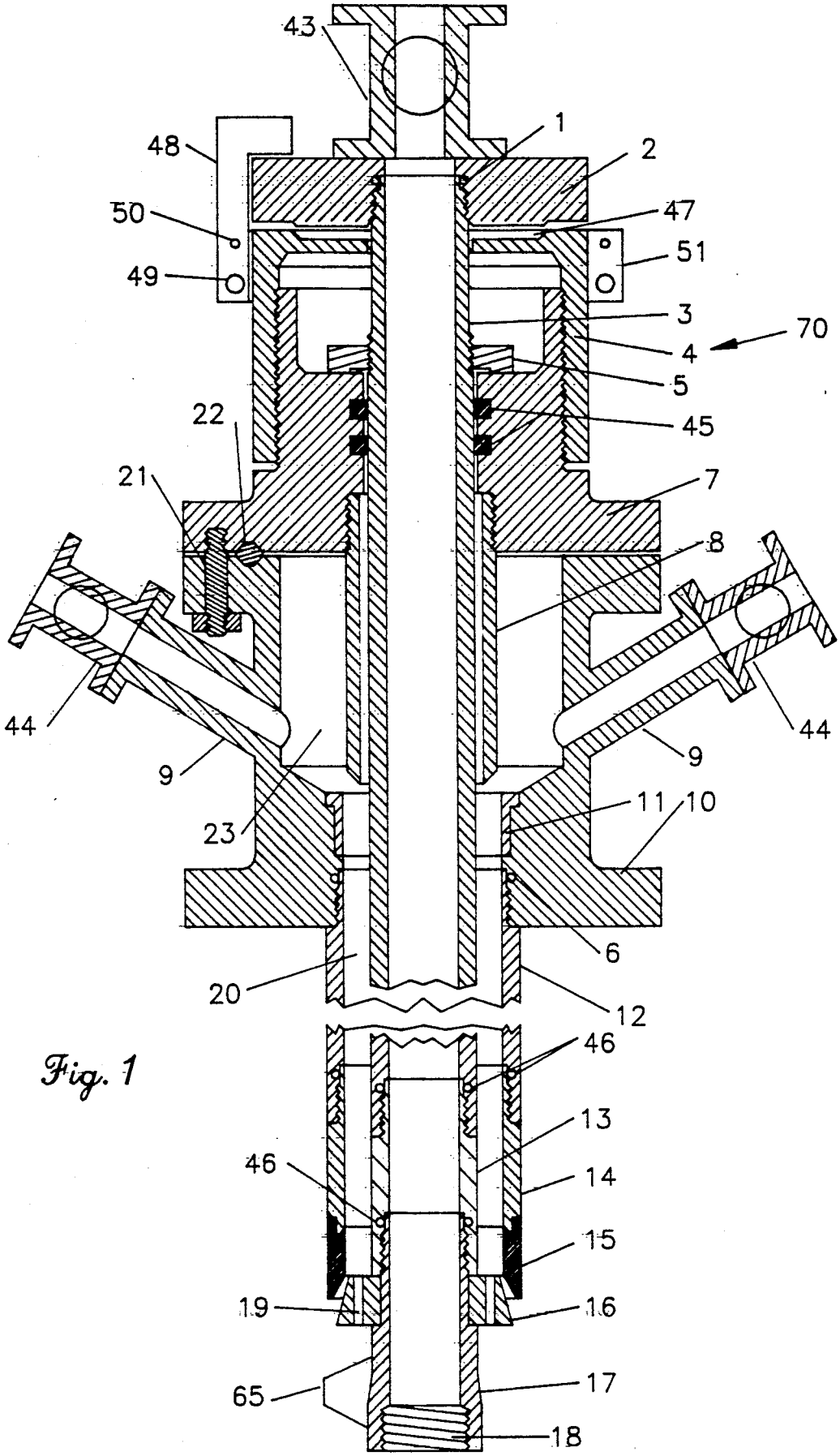
FIG. 1 shows an apparatus according to the invention in side view cross-section.

Referring to FIG. 1, the wellhead isolation tool 70 is made up of a main body 10 with angled fluid flow passage means 9, with side control valves 44. The number of flow passage means 9 ranges from one to several depending on the size of the apparatus. Two are shown in the figures. The wellhead isolation tool 70 is further made up of annulus 23 formed in the main body cavity by a wear sleeve 8 and a bored inner mandrel 3, a concentric wear ring 11 and a threadingly attached bored outer mandrel 12 with seal 6. The outer mandrel 12 has a. diameter the same as the stabbing joint 40 shown in FIG. 4.

The bonnet 7 is attached to the main body 10 by appropriate bolting 21 and sealing 22 as is known in the art. At its upper extremity, the inner mandrel 3 is threadingly attached to the flange connection 2 with seal 1, and top control valve 43 defining first fluid passage means. Stop nut 5, threadingly locked in place on this inner mandrel 3, is located a measured distance from the flange connection 2. The inner mandrel runs concentricly down through the bonnet 7, the seals 45, the wear sleeve 8, which is threadingly attached in the bonnet 7, through the main body 10 and its wear ring 11, the outer mandrel 12, and terminates at its lower extremity with a threadingly attached bored changeover 17 with internal tubing thread 18. The inner mandrel 3 does not need to be one complete length of material but may have an extension 13.

Collectively, the flange 2, bonnet 7 and main body 10 constitute the body as referred to in the claims. Also, as referred to in the claims, the wear prevention means includes the wear sleeve 8.

The outer mandrel 12, which may be made up of sections, terminates at its lower extremity at the threadingly attached bored nipple 14 which has an attached elastomeric sealing medium 15. Together, the nipple 14 and elastomeric sealing medium 15 constitute sealing means. The elastomeric sealing medium 15 is shaped to accept the ported nipple expander 16 with its internal ports or passages 19. This ported nipple expander 16 is constrained in place on the inner mandrel by the changeover 17. The centralizing wings 65 are attached to the changeover 17. The number of these wings is usually 3, but more or less could be used.

The annulus 20 is formed by the inner mandrel 3 and the outer mandrel 12. The locking nut 4 runs threadingly on the bonnet 7 and abuts the flanged connection 2 in the centralizing depression 47. The ear 51 is attached to the locking nut 4 and has the latch 48 swingingly attached by the hinge pin 49 and held in place by the safety pin 50. There are two or more latches, depending on the weight of the apparatus. These latches also serve as handles with which to turn the locking nut 4. Appropriate seals are generally noted at 46.

Figure 2A:
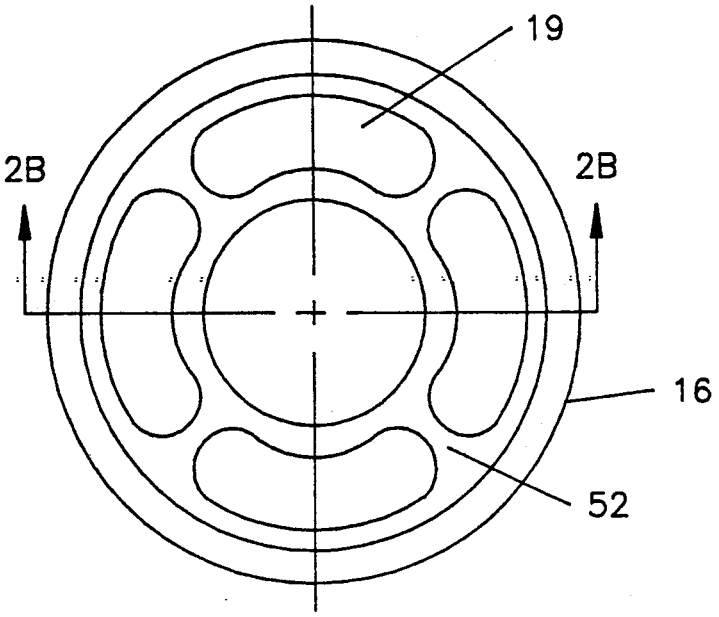
FIG. 2*a* shows a ported nipple expander in top view.
Figure 2B:
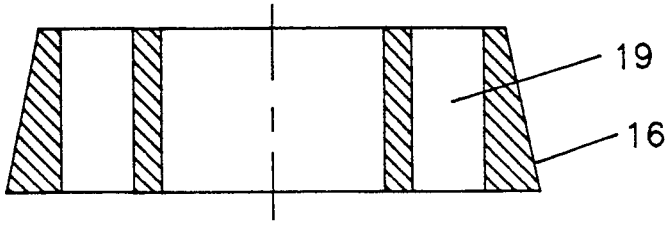
FIG. 2*b* shows a cross-section along the line 2*a* of the ported nipple expander in FIG. 2*a*.
Figure 2C:
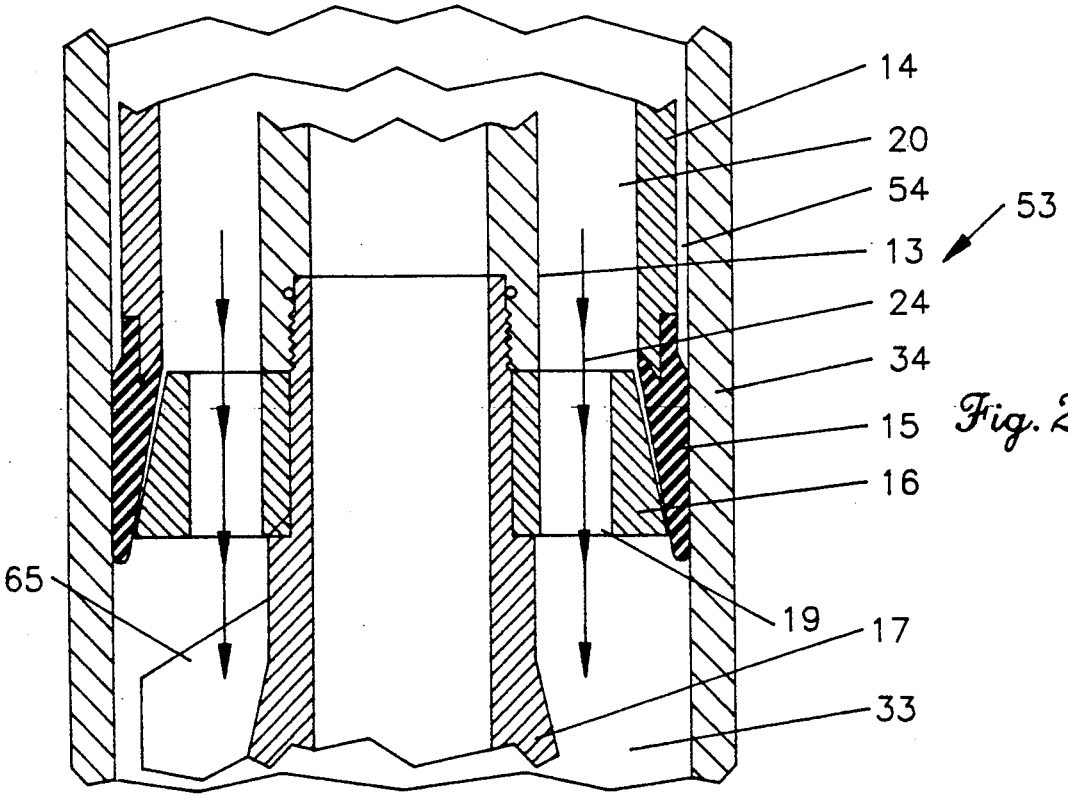
FIG. 2*c* shows a side section view of a ported nipple expander together with nipple sealing medium and well casing.

Referring to FIGS. 2*a*, 2*b* and 2*c*, the ported nipple expander 16 has ports 19 and legs 52. The ports 19 may be of a different configuration such as all distinct holes or with squared ends and the legs 52 may be more or few in number than shown. The configuration shown has been experimentally proven to be adequate. The action of the ported nipple expander 16 (referenced to sometimes simply as "expander") is shown generally at 53. When the expander 16 is moved into the elastomeric sealing medium 15 of the nipple 14 by the action of moving the internal mandrel extension 13 and its attached changeover 17 in an upward direction, this medium is forced out concentricly and seals against the casing 34, thus sealing the small annulus 54 formed by the casing and external mandrel from any pressure below the nipple. At the same time, fluid flowing down the annulus 20 will go through the ports 19 and on down the well annulus 33. Fluid flow is shown at 24.

The apparatus of FIGS. 1, 2*a*, 2*b* and 2*c* must be attached to the tubing 32 and FIGS. 3 to 9 inclusive show how this accomplished.

Figure 3:
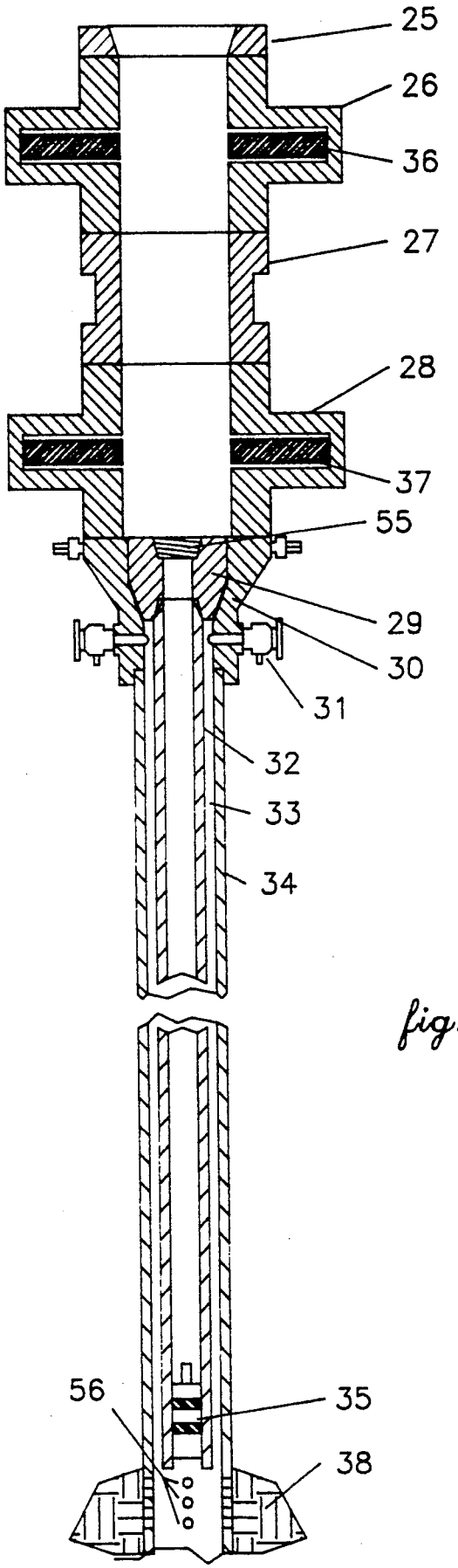
FIG. 3 shows a side view cross-section of a simplified wellhead to which an apparatus according to the invention may be attached.

Referring to FIG. 3, an idealized wellhead and well is shown. This configuration consists of a well formation at 38 (the oil or gas bearing geologic feature), casing 34 with communication to the formation through holes 56, tubing 32 with a plug 35, which tubing terminates threadingly at its uPPer extremity in the dog nut 29, this dog nut 29 being held sealingly in the tubing head 30 which has outlet valves 31 ported to the annulus 33 formed by the tubing 32 in the casing 34. The dog nut 29 also features an internal thread 55. The casing 34 is attached to the tubing head 30. The lower blowout preventer (BOP) 28 with its fitting sealing gates 37 is sealingly attached to the tubing head with the intermediate spool 27 and the upper BOP 26 with its fitted sealing gates 36 likewise sealingly attached, together with slips ring 25. There are many ports, bolts and actuating mechanisms not shown that are associated with the usual wellhead, which would be known to a person skilled in the art.

In FIGS. 4 to 14 inclusive, features shown in FIGS. 1, 2*a*, 2*b*, 2*c* or 3 are given the same numerical identification and the same description applies as above.

Figure 4:
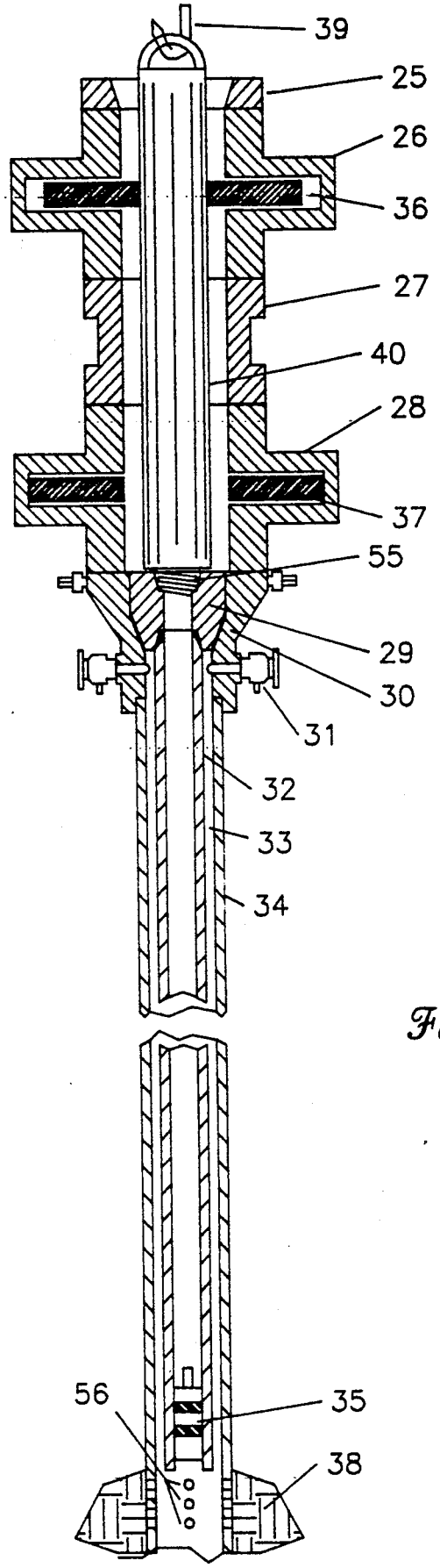
FIG. 4 shows the simplified wellhead of FIG. 3 with a large diameter stabbing joint.

Referring to FIG. 4, there is shown a lifting hook 39 from an outside source such as a service rig or a high capacity hoisting truck and stabbing joint 40. The stabbing joint 40 is in placé to pull the dog nut 29 and tubing 32 out of the well. The upper BOP 26 is closed on the stabbing joint 40. The upper BOP 26 sealing gates are fitted to this stabbing joint 40, and the outer mandrel of the wellhead isolation tool 70 shown in FIG. 1 is of the same diameter.

Figure 5:
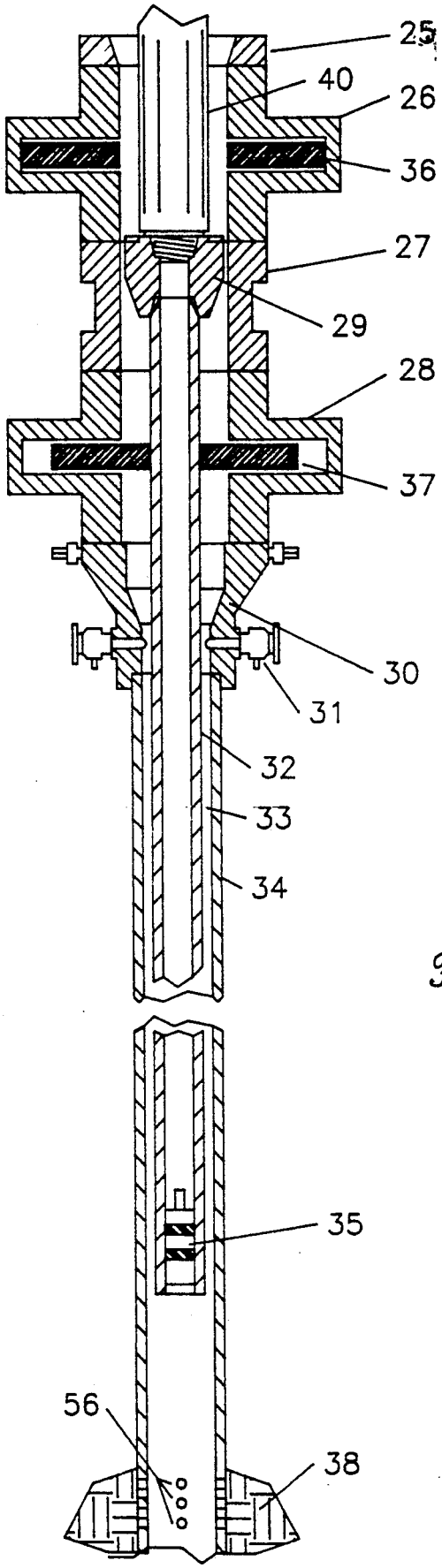
FIG. 5/shows the wellhead of FIG. 4 with dog nut and attached tubing being pulled up through the blowout preventer (BOP)

FIG. 5 shows the dog nut 29 and attached tubing 32 being pulled up through the BOPs 26 and 28. The lower BOP 28 is closed on the tubing and the upper BOP 26 is open.

Figure 6:
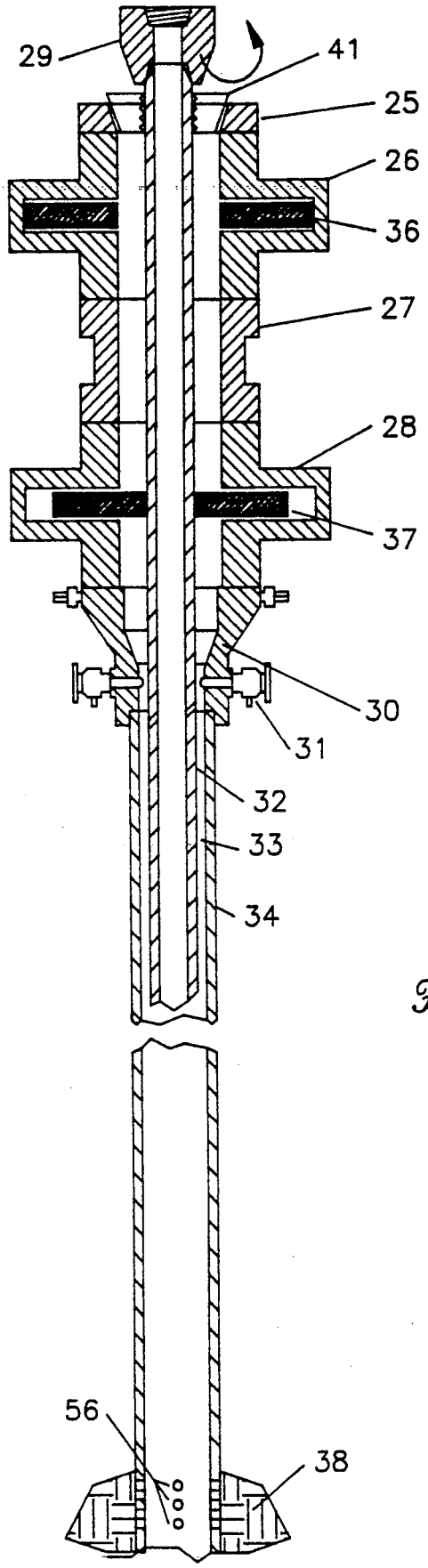
FIG. 6 shows the wellhead of FIG. 5 with the dog nut pulling o/ut of the wellhead equipment.

FIG. 6 shows the insertion of the slips 41 in the slips ring 25 to hold the tubing 32 and dog nut 29 in place. A wrenching movement unscrews the dog nut 29 from the tubing 32. The dog nut 29 is fully out of the wellhead equipment while the tubing 32 is held by the slips 41. The slips 41 may be of the internal, single ring or split ring type.

Figure 7:
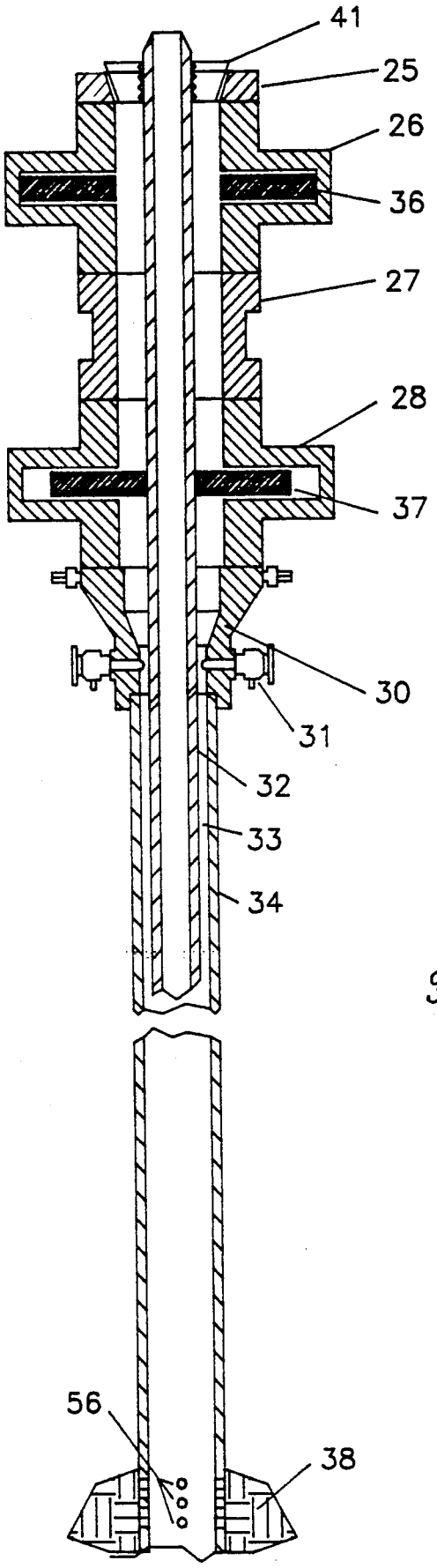
FIG. 7 shows the wellhead of FIG. 6 with the dog nut screwed off in preparation for screwing on the apparatus according to the invention shown in FIG. 1.

FIG. 7 shows the dog nut 29 having been removed. The tubing 32 is held in the slips 41 in preparation for screwing on the wellhead isolation tool shown in FIG. 1.

Figure 8:
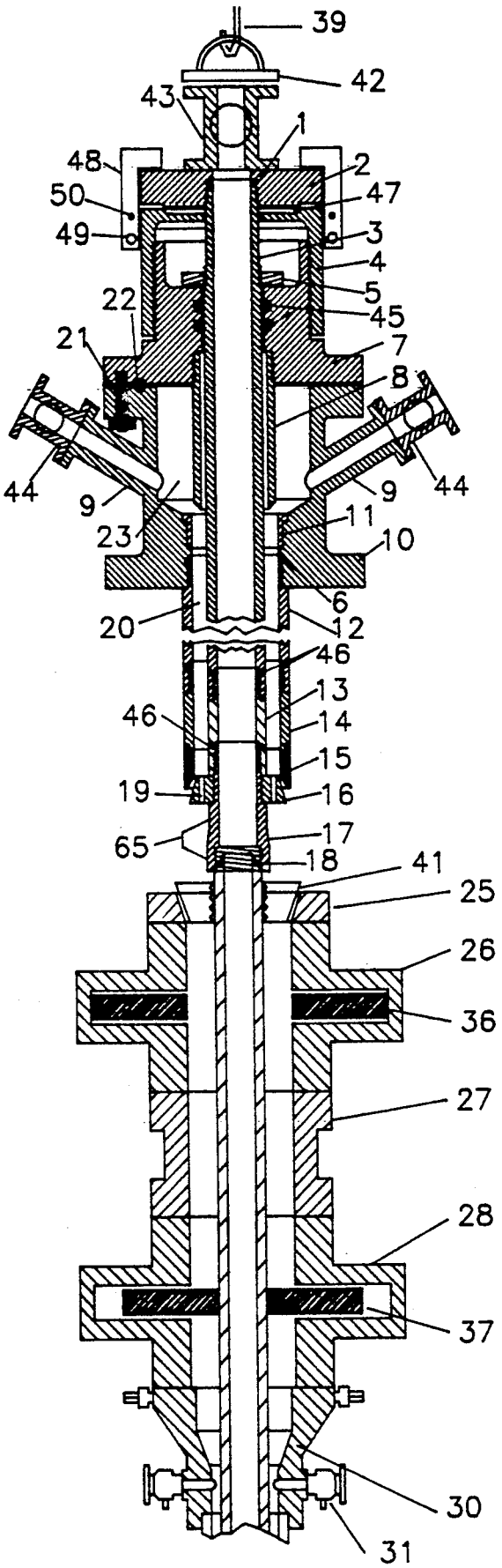
FIG. 8 /shows a side view cross-section of the wellhead with the apparatus of FIG. 1 screwed onto the tubing.

FIG. 8 shows the lifting ring 42 on the top control valve 43. The top control valve 43 and the side control valves 44 are in the closed position. The changeover 17 on the wellhead isolation tool 70 has been sealingly threaded onto the tubing 32.

Figure 9:
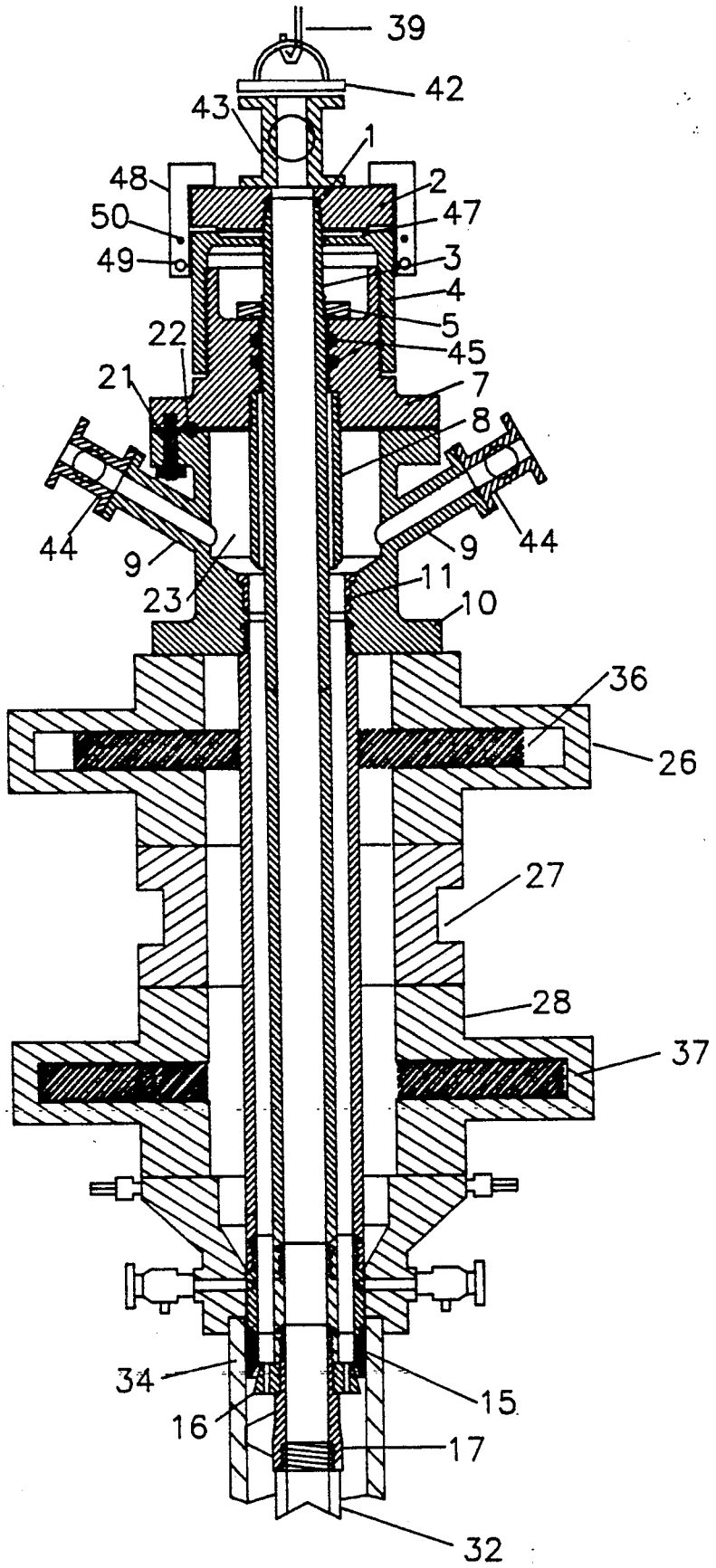
FIG. 9/shows the side view cross-section of the wellhead of FIG. 8 with the apparatus according to the invention lowered into place.

FIG. 9 shows the wellhead isolation tool 70 as lowered into and bolted in place onto the wellhead casing 34. The nipple 14 is positioned in the casing 34. The lower BOP 28 is open and the upper BOP 26 is closed on the outer mandrel 12.

Figure 10:
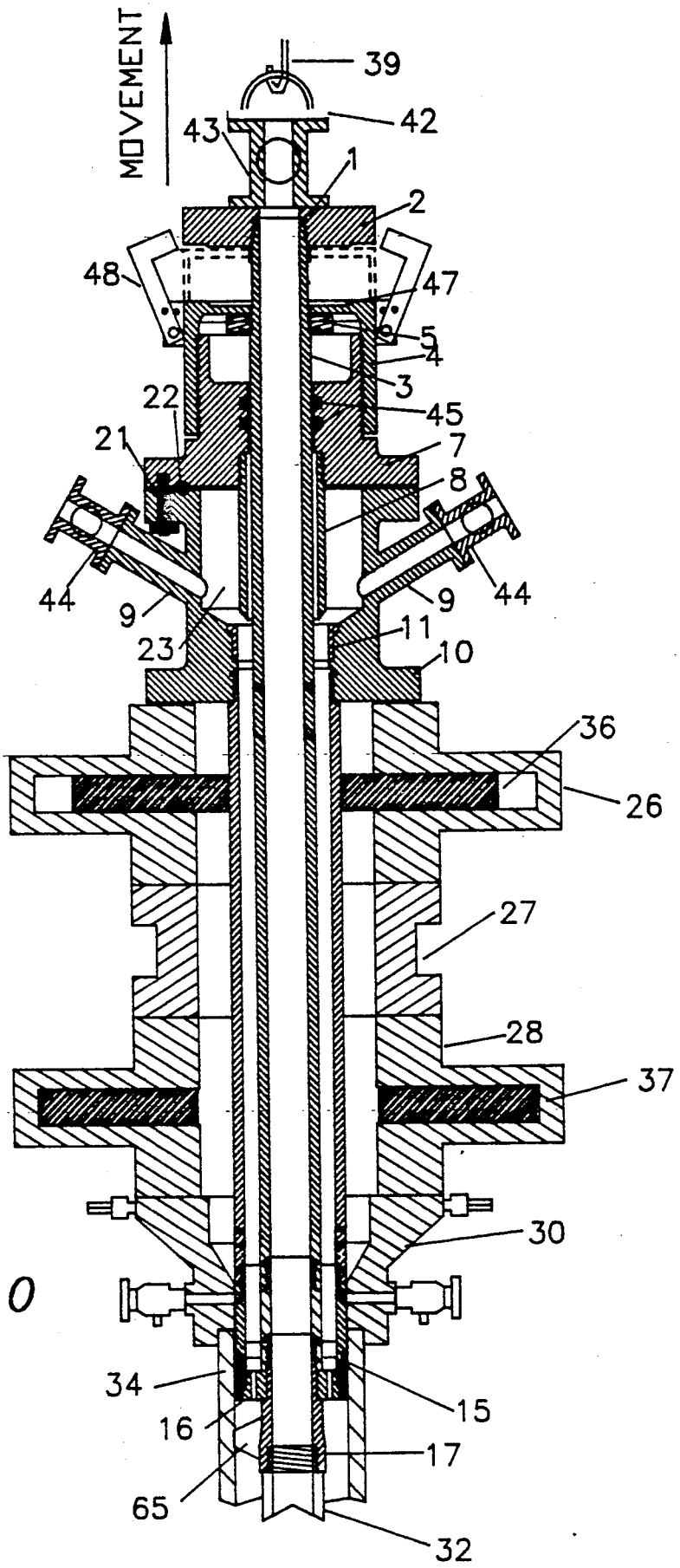
FIG. 10 shows the wellhead of FIG. 9 with the inner mandrel pulled upwards as shown in detail in FIG. 2.

FIG. 10 shows the latches 48 unlocked, the inner mandrel 3 moved upward by the hook 39 till the stop nut 5 abuts the locking nut 4. As shown in phantom lines, the locking nut 4 is rotated to abut the flange connection 2. The expander 16 is shown moved into the sealing medium 15 on the nipple 14 and the sealing medium 15 is sealed against the casing 34.

Figure 11:
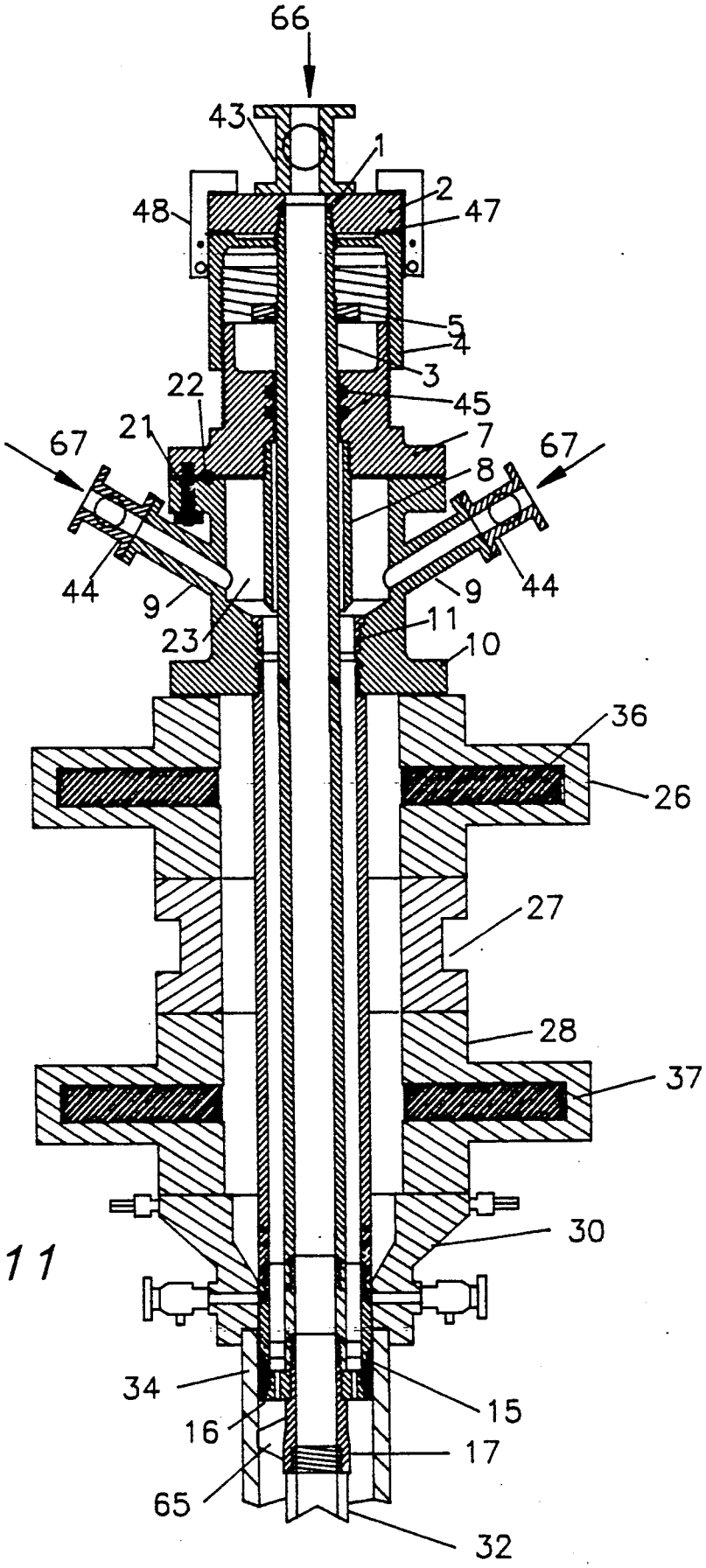

FIG. 11 shows the latches 48 returned to the latched position, and the wellhead isolation tool 70 sealed in place in the wellhead with ported access to the interior of both the tubing 32 and the annulus 33.

DESCRIPTION OF THE OPERATION OF THE PREFERRED EMBODIMENT

Referring to FIG. 3, the well is shown with pressure from the formation in the annulus 33. The tubing 32 has been plugged and there is no pressure in the tubing. The gates in both BOPs 26 and 28 are open.

Referring to FIG. 4, a stabbing joint 40 is lowered in by a hoist (not shown) and threaded into the dog nut 29. The upper BOP gates 36, sized to fit the stabbing joint 40 are closed on the stabbing joint 40 and will seal off the formation pressure present in the annulus 33 when the dog nut 29 is moved. It would be obvious to a person skilled in the art that depending on the formation pressure, this operation may require the use of "snubbing" procedures rather than hoisting. Snubbing procedure allows tubulars to be moved in and out of the well under high pressures and will not be described as it is well known in the field.

Referring to FIG. 5, the dog nut 29 with its attached tubing has been lifted up into the intermediate spool, the lower BOP gates 37 closed on the tubing and in the upper BOP 26 open. The formation pressure is now sealed by the lower BOP 28.

Referring to FIG. 6, the slips 41, which have teeth conforming to the tubing 32, have been put in place in the slips ring 25 holding the tubing 32. The dog nut 29 is taken off leaving the configuration as shown in FIG. 7

Referring to FIG. 8, the wellhead isolation tool 70 is lifted to a position above and concentric with the tubing 32 and the changeover 17 is threaded onto the tubing 32. The wellhead isolation tool is rotated during this operation. The valves 44 and top valve 43 have been connected to the various entry ports to the wellhead isolation tool 70 and are in the closed position. The apparatus is now ready to be lifted with the attached tubing 32 in order to take out the slips 41 and then will be lowered onto the wellhead with the mandrels 3 and 12 and nipple 14 moving through the wellhead and down into the casing.

Referring to FIG. 9, the wellhead isolation tool 70 has been lowered into place by first closing the upper BOP 26 on the outer mandrel 12 after the nipple 14 has passed the sealing gates 36 and then opening the lower BOP 28 to allow the mandrels 3 and 12 to pass through into the casing 34. The wellhead isolation tool 70 is bolted into place on the wellhead.

Referring to FIG. 10, the latches 48 are unpinned and swung out to disengage them from the flanged connection 2. The inner mandrel 3 is lifted upwards until the stop nut 5 abuts the lock nut 4. This is a measured distance, and translates into moving the expander 16 into the nipple elastomeric sealing medium 15 and thus sealing the outer mandrel 12 against the casing 34 as is shown in detail in FIG. 2. The lock nut 4 is now rotated in a direction that will make it abut the flanged connection 2 as shown by the phantom lines.

Referring to FIG. 11, the hook 39 and lifting ring have been removed and it is seen that the wellhead isolation tool 70 is secure on the wellhead, the inner mandrel 3 is locked in place, and the various fluid passages are sealed to isolate the wellhead equipment from fluids flowing in the passages. After the tubing plug 35 has been removed by the usual means, with appropriate connections to outside equipment, fluids may be introduced into the tubing 34 and the annulus 33 of the well. The upper BOP 26 is open to check that proper sealing has taken place. It will be noted that the removal of the wellhead isolation tool 70 is essentially the reverse of the installation.

Referring to FIG. 11, fluid flow may, as shown at 66, be through the top valve 43, through the bore of the inner mandrel 3 and down the well tubing 32, and also, as shown at 67, may be through the side control valves 44, main body annulus 23, inner and outer mandrel annulus 22 and down the tubing and casing annulus 33.

Alternatively, fluid flow may be through the side control valves 44 and thus down the well annulus 33. In this case, instrumentation (either at the top of the control valve 43 or down the tubing 34) may be used. There is no flow up the well tubing 34 in this case.

In another configuration, fluid flow may be through the top control valve 43 and thus down the well tubing 34, with the return of the well annulus 33 exiting through the side control valves 44. This direction is reversible.

Installation, use and removal of the wellhead isolation tool 70 from a well which is not under pressure and which only has one BOP in place as a safety measure is accomplished in the same manner as described, with the deletion of the use of the tubing plug 35 and the operation of the BOP.

ALTERNATIVE EMBODIMENT

There will now be described an alternative embodiment of the wellhead isolation tool in which the expanded nipple is driven into the well casing without subsequent expansion. In this embodiment, the apparatus for pulling the inner mandrel 3 into the outer mandrel 12 is not required since the inner mandrel 3 is not required to move in relation to the outer mandrel 12.

Figure 12:
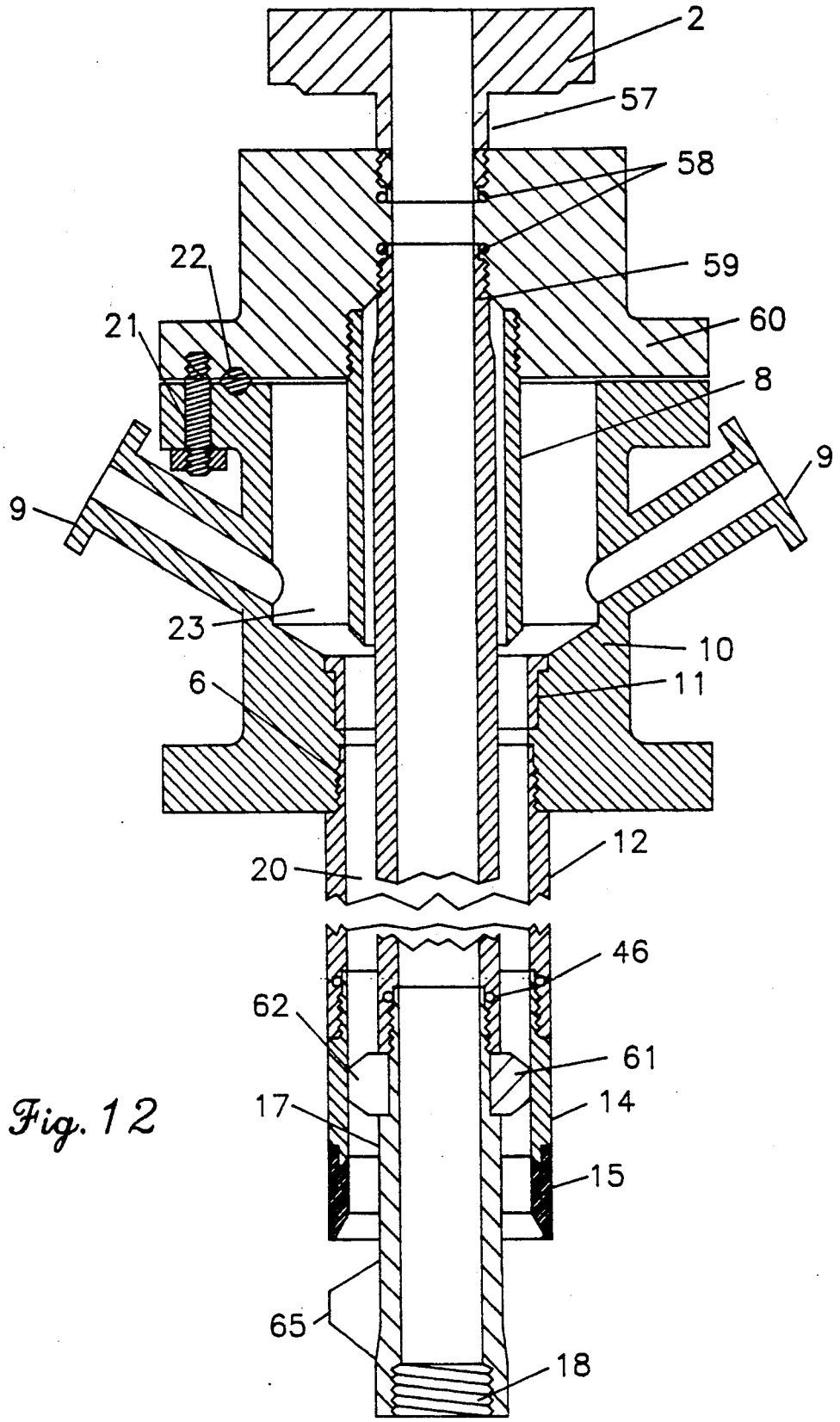
FIG. 12 shows a side view cross-section of an alternative embodiment of the invention.
Figure 13:
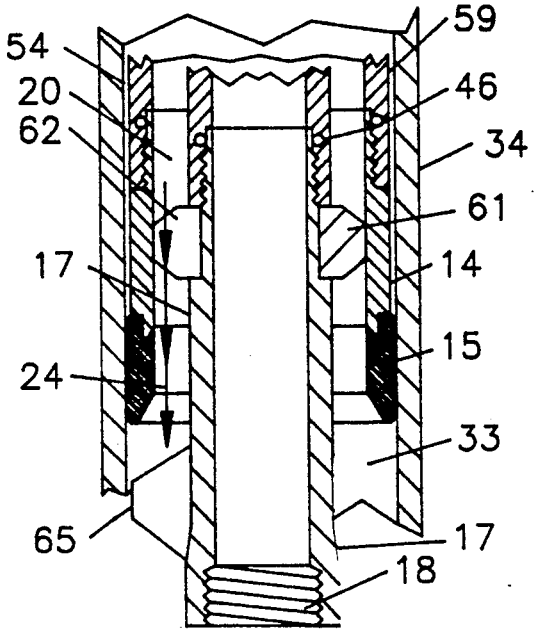
FIG. 13 shows a detail of the nipple of FIG. 12.
Figure 14:
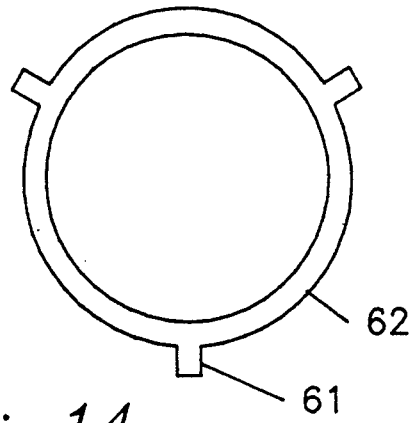
FIG. 14 shows a top view of the guide ring located on the mandrel and changeover of FIG. 13.

The alternative embodiment of the wellhead isolation tool 70 is shown in FIGS. 12, 13 and 14. Like parts in the various figures have been given like numerals.

Referring to FIG. 12, the wellhead isolation tool 70 is made up of the main body 10, with angled flow passages 9, the number of flow passages ranging from 1 to several, depending on the size of the wellhead isolation tool 70, and annulus 23 formed in the main body cavity by the wear sleeve 8 and the bored inner mandrel 59, a concentric wear ring 11 and a threadingly attached bored outer mandrel 12 with seal 6. This outer mandrel has an outside diameter the same as the stabbing joint 40 shown in FIG. 4.

The bonnet 60 is attached to the main body by appropriate bolting 21 and sealing means 22. At its upper extremity, the inner mandrel 3 is threadingly attached to the bonnet 60. The bored connector pipe 57 is threadingly attached to the upper extremity of the bonnet 60, and through the flanged connection 2. Appropriate seals 58 are shown.

At its lower extremity, the inner mandrel 59 terminates at the threadingly attached bored changeover 17 which features an internal thread 18, a shoulder for the internal mandrel centralizing ring 62 with the legs 61 and a centralizing wing 65. The inner mandrel 59 need not be in one section, but may be made of several attached lengths. The outer mandrel 12, which may be made up of several sections, terminates at its lower extremity at the threadingly attached nipple 14 which has on it the elastomeric sealing medium 15. This elastomeric sealing medium may be of diverse shapes but it will be of such an outer diametric dimension that it will have a larger outside diameter than the inside diameter of the casing which it is to seal.

Referring to FIG. 13, a detail of the nipple 14 with its elastomeric sealing medium 15 is shown in sealing contact with the well casing 34. The elastomeric seal medium is compressed against the casing due to the outside diameter of the sealing medium being larger than the inside diameter of the casing. This effectively seals the annulus 54 above the sealing medium from the well annulus 33. The sealed annulus 54 is shown and the connection between the annulus 20 and the well annulus 33 is evident. The inner mandrel centralizing ring 62 is shown in place on the changeover 17.

Referring to FIG. 14, the internal mandrel centralizing ring 62 is shown with its centralizing legs 61.

The installation procedure of this embodiment of the wellhead isolation tool 70 on the wellhead and into the casing follows exactly the installation procedure outlined for the apparatus with the expanding nipple up to the point shown in FIG. 9. In this figure, the elastomeric nipple sealing medium 15 has been forced into the casing 34 and is no in sealing engagement with it due to the interference of the large outside diameter of this elastomeric medium and the casing inside diameter. It is noted that the action of the inner mandrel centralizing ring 62 is to keep the outer mandrel 12 central with the wing-guided inner mandrel 59 when entering the casing. Both of these mandrels can be quite long, and if no centralizing means is used, damage to the seal medium can result during the installation procedure.

The various flow directions of FIG. 11 are the same for the expanding nipple apparatus.

There are several disadvantages to this embodiment including: (1) with reference to FIG. 3, the point where the tubing head 30 joins the casing 34, there is often a sharp or jagged edge due to the method of joining the two parts, that is by welding or screwing for example. This edge will cut the elastomeric sealing medium and cause the seal to fail. Also, (2) the well casings come in a variety of inside diameters and the records are not always correct as to the size of casing in the well. If the casing is of a smaller inside diameter than properly fits the sealing medium, the seal can be damaged when being forced in. If the inside diameter of the casing is of a larger diameter than the sealing medium, then a proper seal will not be made.

Thirdly, corrosion of the inside of the casing leaves a rough and pitted surface for the sealing medium to seal against. It is not always possible to seal against this type of surface with only the force available through an interference fit of the elastomeric sealing medium against this corroded surface. Finally, other pieces of equipment on the actual wellhead array will have sharp shoulders and undersized inside diameters which will damage the elastomeric seal and lead to failure of the apparatus. For these reasons, the expanding nipple configuration of this apparatus is the best arrangement known to the inventor.

Although a specific preferred embodiment of the present invention has been described in the detailed description above, the description is not intended to limit the invention to the particular forms of the embodiment disclosed, since they are to be recognized as being illustrative rather than restrictive, and it would be obvious to those skilled in the art that the invention is not so limited.

For example, it would be obvious from this disclosure that it would be possible to utilize a concentric hydraulic cylinder under the lock nut with a piston attached to the inner mandrel in place of the stop nut to move the inner mandrel. It would also be obvious to devise a threaded union to take the place of the latches on the lock nut which would hold the apparatus together during running in. It would also be obvious to devise a different shape of elastomeric sealing medium for sealing between the outer mandrel nipple and the casing. Also, someone skilled in the art may discard the bored connector pipe and the flanged connection on this embodiment and make the flanged connection integral with the bonnet, although this is a retrograde improvement as these parts are subject to erosion and it is easier to replace a short pipe and flange than a whole bonnet.

Thus it will be understood that various immaterial modifications could be made to the invention, and these are intended to be covered by the claims that follow.

I claim:

1. In a wellhead isolation tool having a body for external mounting on a wellhead, the wellhead having well tubing and casing, an outer mandrel supported in the body and having a lower end, and an inner mandrel supported within the outer mandrel and connectable to the well tubing, the improvement comprising:

annular sealing means attached to the lower end of the outer mandrel for sealing against the casing;

first fluid passage means attached to the body for providing fluid into the tubing;

at least one second fluid passage means attached to the body for providing fluid into the annulus between the inner and outer mandrel;

an expander for expanding the sealing means into sealing relationship with the casing; and the expander having axial passages extending through the expander to provide a connection between the annulus formed by the casing and tubing and the annulus formed by the inner and outer mandrels.

2. In the wellhead isolation tool of claim 1, the improvement further comprising:

the inner mandrel being axially movable in relation to the outer mandrel; and the expander being movable from a position away from the sealing means to a position in which the sealing means is expanded.

3. In the wellhead isolation tool of claim 1, the improvement further comprising:

each of the second passage means for providing fluid to the annulus between the inner and outer mandrel being disposed at an angle to the inner and outer mandrel; and wear prevention means disposed on the inner mandrel at least adjacent to one of the second passage means for preventing erosion of the inner mandrel.

4. In a wellhead isolation tool having a body for external mounting on a wellhead, the wellhead having well tubing and casing, an outer mandrel supported in the body and having a lower end, and an inner mandrel supported within the outer mandrel and connectable to the well tubing, the improvement comprising:

annular sealing means attached to the lower end of the outer mandrel for sealing against the casing;

first fluid passage means attached to the body for providing fluid into the tubing;

at least one second fluid passage means attached to the body for providing fluid into the annulus between the inner mandrel and the outer mandrel;

each of the second passage means for providing fluid to the annulus between the inner and outer mandrel being disposed at an angle to the inner and outer mandrel; and wear prevention means disposed on the inner mandrel at least adjacent to one of the second passage means for preventing erosion of the inner mandrel.

5. A wellhead isolation tool for mounting on a wellhead, the wellhead isolation tool comprising:

a body for external mounting on the wellhead, the wellhead having well tubing and well casing;

an outer mandrel supported in the body and having a lower end;

an inner mandrel supported within the outer mandrel and connectable to the well tubing;

a sealing nipple on the lower end of the outer mandrel;

an expander disposed against the inner mandrel for expanding the sealing nipple into sealing relationship with the casing;

the expander having axial passages extending through the expander to provide a connection between the annulus formed by the casing and the tubing and the annulus formed by the inner and outer mandrel;

first fluid passage means for providing fluid into the tubing; and at least one second passage means for providing fluid into the annulus formed by the inner and outer mandrel.

* * * * *